US010028874B2

(12) United States Patent
Koch

(10) Patent No.: US 10,028,874 B2
(45) Date of Patent: Jul. 24, 2018

(54) OPERATING TABLE BASE FOR AN OPERATING TABLE

(71) Applicant: Maquet GmbH, Rastatt (DE)

(72) Inventor: Guido Koch, Karlsruhe (DE)

(73) Assignee: MAQUET GMBH, Rastatt (DE)

( * ) Notice: Subject to any disclaimer, the term of this patent is extended or adjusted under 35 U.S.C. 154(b) by 246 days.

(21) Appl. No.: 14/790,325

(22) Filed: Jul. 2, 2015

(65) Prior Publication Data

US 2016/0000623 A1 Jan. 7, 2016

(30) Foreign Application Priority Data

Jul. 4, 2014 (DE) ..... 10 2014 109 376

(51) Int. Cl.
*A61G 13/06* (2006.01)
*A61G 7/018* (2006.01)
(Continued)

(52) U.S. Cl.
CPC ..... *A61G 7/018* (2013.01); *A61G 7/012* (2013.01); *A61G 7/05* (2013.01); *A61G 13/04* (2013.01); *A61G 13/104* (2013.01); *A61G 13/08* (2013.01)

(58) Field of Classification Search
CPC ..... A61G 13/06; F16M 11/20
(Continued)

(56) References Cited

U.S. PATENT DOCUMENTS 2,059,130 A 10/1936 May
2,532,677 A 12/1950 Hyman
(Continued)

FOREIGN PATENT DOCUMENTS

CN 1392788 A 1/2003
CN 201147445 Y 11/2008
(Continued)

OTHER PUBLICATIONS

Chinese Office Action and Chinese Search Report (including English translation) dated Oct. 9, 2016 which issued during the prosecution of corresponding Chinese Patent Application No. 201510378762.X, 8 pages.
(Continued)

*Primary Examiner* — Fredrick C Conley
(74) *Attorney, Agent, or Firm* — Aaron M. Miller

(57) ABSTRACT

An operating table base for an operating table is disclosed. The operating table base comprises at least two transport rollers that are moveable between a retracted position, in the base, and an extracted position, extending from the base. The operating table rests on at least one support element of the operating table when the rollers are in the retracted position. The operating table is movable on the transport rollers when the rollers are in the extracted position. The operating table base includes a first mechanical adjusting unit for moving the first transport roller between the retracted position and the extracted position and a second mechanical adjusting unit for moving the second transport roller between the retracted position and the extracted position. Both the first and the second adjusting units are actuatable by a first drive unit which is connected to the first and the second adjusting units via a mechanical connecting means.

21 Claims, 11 Drawing Sheets

(51) Int. Cl.

| | |
|---|---|
| ***A61G 13/10*** | (2006.01) |
| ***A61G 7/012*** | (2006.01) |
| ***A61G 7/05*** | (2006.01) |
| ***A61G 13/04*** | (2006.01) |
| *A61G 13/08* | (2006.01) |

(58) Field of Classification Search
USPC ..... 5/600, 611
See application file for complete search history.

(56) References Cited

U.S. PATENT DOCUMENTS

| | | | | |
|---|---|---|---|---|
| 2,897,029 | A | 7/1959 | Maisel | |
| 3,042,131 | A | 7/1962 | Dovci | |
| 3,393,004 | A | 7/1968 | Earl | |
| 3,579,671 | A | 5/1971 | Koetter | |
| 3,739,406 | A | 6/1973 | Koetter | |
| 3,900,906 | A | 8/1975 | Berthelsen | |
| 4,667,354 | A | 5/1987 | Carey, Jr. | |
| 4,912,787 | A | 4/1990 | Bradcovich | |
| 4,958,817 | A | 9/1990 | Heller | |
| 5,074,000 | A | 12/1991 | Soltani | |
| 5,181,288 | A | 1/1993 | Heaton | |
| 5,299,334 | A | 4/1994 | Gonzalez | |
| 5,477,570 | A | 12/1995 | Hannant | |
| 5,528,782 | A | 6/1996 | Pfeuffer | |
| 5,621,933 | A | 4/1997 | Knapp et al. | |
| 5,624,375 | A | 4/1997 | Dykes | |
| 5,791,233 | A | 8/1998 | Knapp | |
| 6,640,363 | B1 | 11/2003 | Pattee | |
| 6,678,907 | B1 | 1/2004 | Voelker et al. | |
| 7,257,850 | B1 | 8/2007 | Tekulve | |
| 7,913,337 | B1 | 3/2011 | Masson | |
| 8,657,243 | B2 | 2/2014 | Marugg | |
| 8,677,529 | B2 | 3/2014 | Jackson | |
| 9,295,598 | B2 | 3/2016 | Roussy | |
| 2003/0074735 | A1 | 4/2003 | Zachrisson | |
| 2005/0015878 | A1 | 1/2005 | Bannister | |
| 2005/0144722 | A1* | 7/2005 | Pfeuffer | A61G 7/0528 5/600 |
| 2010/0211099 | A1 | 8/2010 | Radermacher | |
| 2010/0275371 | A1 | 11/2010 | Turner | |
| 2011/0010858 | A1 | 1/2011 | Tesar | |
| 2016/0000627 | A1 | 1/2016 | Jackson | |
| 2016/0000628 | A1 | 1/2016 | Koch | |
| 2016/0089287 | A1 | 3/2016 | Buerstner | |
| 2016/0095773 | A1 | 4/2016 | Ruch | |

FOREIGN PATENT DOCUMENTS

| | | | |
|---|---|---|---|
| CN | 102631271 | A | 8/2012 |
| CN | 103596538 | A | 2/2014 |
| CN | 103767847 | A | 5/2014 |
| DE | 1798342 | U | 10/1959 |
| DE | 1 928 624 | U | 12/1965 |
| DE | 43 41 779 | A1 | 6/1995 |
| DE | 44 23 402 | A1 | 1/1996 |
| DE | 196 23 580 | C2 | 12/1997 |
| DE | 10 2010 020 129 | A1 | 11/2011 |
| DE | 10 2010 051 126 | A1 | 5/2012 |
| DE | 10 2011 000 628 | A1 | 8/2012 |
| DE | 10 2011 103 546 | A1 | 12/2012 |
| GB | 1559945 | A | 1/1980 |
| JP | H08-182711 | A | 7/1996 |
| JP | H09-124277 | A | 5/1997 |
| JP | 2003-527921 | A | 9/2003 |
| JP | 2004-511289 | A | 4/2004 |
| JP | 2005-144174 | A | 6/2005 |
| JP | 2014-039593 | A | 3/2014 |
| JP | 5518960 | B2 | 6/2014 |

OTHER PUBLICATIONS

Extended European Search Report dated Nov. 4, 2015 issued for corresponding EP Patent Application No. 15171217.1, 7 pages.

English translation of Chinese Office Action and Chinese Search Report dated Aug. 22, 2016 which issued during the prosecution of related Chinese Patent Application No. 201510387488.2, 9 pages.

English translation of Japanese Office Action dated Jun. 28, 2016, which issued for related JP Patent Application No. 2015-129951, 3 pages.

Extended European Search Report dated Nov. 4, 2015 issued for related EP Patent Application No. 15171193.4, 6 pages.

Extended European Search Report dated Nov. 4, 2015 issued for related EP Patent Application No. 15171179.3, 7 pages.

Korean Office Action dated Aug. 10, 2016, which issued for corresponding KR Patent Application No. 10-2015-0095246, 6 pages.

Japanese Office Action dated Jul. 12, 2016 which issued during the prosecution of corresponding Japanese Patent Application No. 2015-127480, 5 pages.

* cited by examiner

OPERATING TABLE BASE FOR AN OPERATING TABLE

CROSS REFERENCE TO RELATED APPLICATIONS

Applicant hereby claims foreign priority benefits under U.S.C. § 119 from German Patent Application No. DE 10 2014 109 376.3 filed on Jul. 4, 2014, the contents of which are incorporated by reference herein.

TECHNICAL FIELD

The invention relates to an operating table base for an operating table. Prior to and during an operation of a patient placed on a patient support surface of an operating table, the patient support surface is brought to a position which facilitates a surgical intervention on the patient. In doing so, it may be necessary to pivot the patient support surface about a horizontal axis by an angle from a wide range of angles. Also the height of the operating table's patient support surface should be adjustable within a range as wide as possible. The operating table ideally further allows for very small heights of the patient support surface, which requires compact construction of the operating table column.

BACKGROUND

Three different types of operating tables are typically used in hospitals, namely stationary operating tables, movable operating tables and mobile operating tables. Stationary operating tables have an operating table column permanently fixed to the floor of an operating room and normally do not comprise an operating table base, and energy is supplied to them via fixedly installed cables. Movable operating tables have an operating table base which is connected to the operating table column and may comprise rollers, and a patient support surface which can be detached from and re-attached to the operating table column.

Operating table bases of mobile operating tables include rollers for moving the operating table so that they can be moved without auxiliary means and are suited for transporting a patient. During the surgical intervention on the patient, on the other hand, a safe stand of the operating table has to be guaranteed. In the case of simple operating tables this is accomplished by locking several transport rollers, while in the case of high-quality operating tables a chassis of the operating table base is lowered so that it rests on the floor. For this, the transport rollers are integrated in the operating table base adjustably in vertical direction and can be moved downward such that the contact of the chassis with the floor is interrupted and the operating table stands on the transport rollers.

Further, with mobile operating tables, the patient support surface usually is fixedly coupled to the operating table column and is not separated from the operating table column in hospital practice. Further, electric traction drives, preferably including soft start and safety brake function can be used, in order to move the mobile operating table by means of the electric traction drive. Stationary operating tables as well as movable operating tables and mobile operating tables may employ components which can be adjusted by means of an electric motor, such as an operating table column which is length adjustable by means of an electric motor for height variation of a patient support surface arranged on the operating table column, an operating table column head which is adjustable about two orthogonal axes for variation of tilt and swing of the patient support surface connected to the operating table column head, and/or components of the patient support surface that can be adjusted by means of an electric motor.

Mobile operating table bases with four integrated transport rollers are known, which have a hydraulic cylinder for each transport roller as well as a common control valve for the vertical adjustment of the respective transport roller. One disadvantage resulting from the use of the hydraulic cylinders is the relatively large vertical space and the relatively high costs. However, for reasons of accessibility, a flat structure of the operating table base is desirable. If the movement of the operating table is to be assisted by means of an electromotive traction drive, a further hydraulic cylinder and a further control valve are required for lowering the traction drive to the floor and for lifting the traction drive from the floor.

SUMMARY

It is the object of the invention to specify an operating table base which, given a simple structure, enables a flat construction and is cost-efficient. This object is solved by an operating table base comprising at least two extractable transport rollers, wherein the operating table rests on at least one support element of the operating table in the retracted state of the transport rollers, wherein the operating table is movable on the transport rollers in the extracted state of the transport rollers, wherein a first mechanical adjusting unit is provided by means of which the state of the first transport roller is changeable at least from the retracted state into the extracted state, that a second mechanical adjusting unit is provided by means of which the state of the second transport roller is changeable at least from the retracted state into the extracted state, and that the first adjusting unit and the second adjusting unit are drivable by means of a first drive unit which is connected to the first and the second adjusting unit via a mechanical connecting element.

The inventive operating table base has at least two extractable transport rollers, wherein the operating table rests on at least one support element of the operating table in the retracted state of the transport rollers, and wherein the operating table is movable on the transport rollers in the extracted state of the transport rollers. The operating table base has a first mechanical adjusting unit by means of which the state of the first transport roller can at least be changed from the retracted state into the extracted state. Further, it has a second mechanical adjusting unit by means of which the state of the second transport roller can at least be changed from the retracted state into the extracted state. The first adjusting unit and the second adjusting unit are drivable by means of a drive unit. The drive unit is connected to the first and the second adjusting unit via a mechanical connecting means.

In the retracted state of the transport rollers, these do not carry the operating table or only to an insignificant extent. In the extracted state of the transport rollers, the transport rollers and possible other rollers bear the weight of the operating table. In particular, one speaks of extracted transport rollers when the transport rollers project downward from the chassis or the housing of the operating table base. Instead of individual transport rollers, each time a transport roller group comprising at least two transport rollers can be employed.

In the extracted state of the transport rollers, the operating table is supported by these rollers and is movable or rollable on the transport rollers. The operating table base can have further transport rollers with or without a separate adjusting unit for extraction of the transport rollers. The non-extractable transport rollers then project permanently from the chassis or the housing of the operating table base.

An advantage of the inventive operating table base over the prior art is the simple structure and the more cost-efficient production. In particular, for extracting the transport rollers, not one separate drive for each transport roller is required but only one single drive for all transport rollers. Also complex hydraulic units, as common in the prior art, can be dispensed with. A further advantage over the prior art is the more flexible positioning option for the drive unit, as a result whereof a lower construction height of the operating table base is possible compared to known operating table bases with extractable transport rollers.

In an advantageous development of the invention, the first and the second adjusting unit are connected to the drive unit via a chain or a belt. An advantage of this development is that a simple, cost-efficient and robust connecting means can be used. Further, the drive unit can be adapted flexibly to the respective structural conditions of the operating table base. It is particularly advantageous when the belt is designed as a toothed belt. This enables an engagement of the toothed belt with the adjusting units that is as safe as in the case of the chain, the toothed belt being maintenance-free and easy to install.

Further, it is advantageous when the chain or the belt, in particular with elements of the drive unit, forms a closed drive train. By closed drive train a drive train without a beginning or an end is understood. This is in particular true for a ring. An advantage of this ring-shaped design is that the connecting means can exert a force on the adjusting units in clockwise and in counterclockwise direction. This can be used to bring the transport rollers from the retracted state into the extracted state when the connecting means is driven in a first direction, and from the extracted state into the retracted state when the connecting means is driven in opposite direction.

Further, it is advantageous when the first drive unit comprises an electric motor which drives a threaded nut of a screw-type or worm gearing via a gear stage, when the internal thread of the threaded nut is engaged with the external thread of a threaded rod, when the threaded nut is mounted stationarily in the direction of the longitudinal axis of the threaded rod and rotatably about the longitudinal axis of the threaded rod, when a first end of the threaded rod is connected to a first end at a first end of the chain or the belt, and when a second end of the threaded rod is connected to a second end of the chain or the belt. Alternatively thereto, the first drive unit comprises a synchronizing cylinder with a first piston rod and a second piston rod. The free end of the first piston rod is connected to a first end of the chain or the belt and the free end of the second piston rod is connected to a second end of the chain or the belt.

Here, by stationary threaded nut it is in particular understood that the threaded nut is not displaceable. In analogy to a rotationally-fixed mounting, one can also speak of a translatory-fixed mounting in this case. By means of this development it is possible that the chain or the belt performs a translatory movement. When the outside of the threaded nut is designed as a gearwheel, the threaded nut can be engaged with the driven shaft of the drive unit which is preferably designed as an electric motor. Preferably, the gear stage is designed as a worm gearing. The worm gearing that is indirectly driven by the drive unit converts the rotary movement of the drive unit into a translatory movement of the chain, the belt or another connecting means. What is advantageous with this embodiment is the little space requirement and the possibility of a precise control of the translatory movement of the mechanical connecting means.

Further, it is particularly advantageous when the mechanical connecting means is engaged with a first gearwheel or gearwheel segment of the first adjusting unit and with a second gearwheel or gearwheel segment of the second adjusting unit, wherein, given a movement of the connecting means engaged with the gearwheels, a rotation of the gearwheels takes place, and wherein, by the rotation of the gearwheels, the transport rollers can be brought from the retracted state into the extracted state and from the extracted state into the retracted state. The adjusting units are preferably designed such that a rotation of the respective gearwheel or gearwheel segment by an angle in the range between 20° and 180° brings the respective transport roller from the retracted into the extracted state. A particularly preferred angular range is 30° to 120°.

An advantage of the above-mentioned design is that by choosing a gearwheel or a gearwheel segment a safe connection between the mechanical connecting means and the adjusting units is guaranteed. This is in particular the case when using a chain or a toothed belt as a connecting means. Further, these circulating connecting means can easily be driven by only one drive unit. By using gearwheels or gearwheel segments the force can easily be transmitted to the adjusting units.

In a further preferred embodiment of the present invention, the first adjusting unit has a vertically arranged first journal with a vertical first longitudinal axis and a first journal guide for guiding a relative movement between the first journal guide and the first journal in vertical direction. The first adjusting unit has at least a first adjusting element with a first inclined surface with which a first engagement element of the first journal guide is engaged such that given a relative movement of the first engagement element along the first inclined surface a translatory adjustment movement of the first adjusting element takes place. In addition, the second adjusting unit has a second journal guide with a second longitudinal axis for guiding a relative movement between the journal guide and the second journal in vertical direction, at least a second adjusting element with a second inclined surface with which a second engagement element of the second journal guide is engaged such that given a relative movement of the second engagement element along the second inclined surface a translatory adjustment movement of the second adjusting element takes place.

Here, by adjustment movement a movement for retracting and extracting the transport rollers is understood. The retraction of the transport rollers changes the state from the extracted state into the retracted state, the extraction changes the state from the retracted state into the extracted state. During the adjustment movement, each time a movement of the adjusting element about the longitudinal axis of the respective journal takes place, along an inclined surface arranged around this longitudinal axis with an inclination with respect to the horizontal. The inclined surface can, for example, be designed as a threaded portion of an external or internal thread. Preferably, two inclined surfaces are employed which are offset relative to each other by an angle of 180°. It is particularly advantageous when three inclined surfaces offset by an angle of 120° with one engagement element each are employed. An advantage of this development is that the inclination of the inclined surfaces is adaptable to the weight force of the operating table. When three inclined surfaces with one engagement element each are employed, the transport roller is moreover held in a stable position.

A further advantageous development is that the upper end of the first journal has a connecting area via which the first journal is firmly connected to a chassis of the operating table base, that the upper end of the second journal has a connecting area via which the second journal is firmly connected to the chassis of the operating table base, that the first adjusting element of the first adjusting unit is rotatably mounted about the first longitudinal axis, and that the second adjusting element of the second adjusting unit is rotatably mounted about the second longitudinal axis. In addition, the first adjusting element and the second adjusting element is connected to the first drive unit via the mechanical connecting means such that they are rotated about the longitudinal axis of the respective journal when driven by the first drive unit, that the first inclined surface rests on the first engagement element when changing the state of the first transport roller, that the second inclined surface rests on the second engagement element when changing the state of the second transport roller, that the first engagement element slides along the first inclined surface or that the first engagement element has a roller which rolls along the first inclined surface, that the second engagement element slides along the second inclined surface or that the second engagement element has a roller which rolls along the second inclined surface, that the state of the first transport roller is changeable by rotation of the first adjusting element, and that the state of the second transport roller is changeable by the rotation of the second adjusting element.

When the adjusting elements each have a gearwheel or a gearwheel segment for connection with the mechanical connecting means, it is advantageous when the teeth of the gearwheel or the gearwheel segment are formed on the outside of the respective adjusting element. As a result, the mechanical connecting means, preferably a chain or a toothed belt, can be designed such that it is arranged around the adjusting elements in a circulating manner. This enables a simple structure of the operating table base. The inclined surface can have a first section with an inclination and in particular at least a second section with an inclination different from the inclination of the first section. The course of the extracting or retracting movement of the transport rollers is thus dependent on the course of inclination and on the drive movement of the drive unit, and is changeable by them.

Preferably, in the extracted state of the transport rollers, no force is exerted on the mechanical connecting means by the weight of the operating table. As a result, the connecting means and the drive unit can have a simpler design. In particular no means for locking the transport rollers in the extracted state have to be provided.

Preferably, the inclined surfaces of the respective adjusting elements with inclinations of greater than 0° are each followed by a level surface having an inclination of 0°. Indications on inclinations and indications on degrees preferably refer to the horizontal each time or to a plane that is orthogonal with respect to the direction of the translatory adjustment movement of the transport rollers from the retracted into the extracted state or from the extracted into the retracted state so that the inclination of 0° has no inclination with respect to the orthogonal plane.

The adjustment movement of the mechanical connecting means caused by the drive unit is performed by the drive unit at least during the extraction of the transport roller until the engagement elements are each engaged with the horizontal level surface, in particular are arranged underneath this horizontal surface. Thus, by the weight of the operating table no force is exerted on the mechanical connecting means, and the operating table is in a stable position. A further advantage is that the operating table does not have to be held in this position by the first drive unit.

Further, it is advantageous when at least a first guiding pin of the first journal guide is received in a first opening of the operating table base, that is complementary to the first guiding pin, such that the first journal guide is mounted about the first longitudinal axis in a rotationally fixed manner and that at least a second guiding pin of the second journal guide is received in a second opening of the operating table base, that is complementary to the second guiding pin, such that the second journal guide is mounted about the second longitudinal axis in a rotationally fixed manner. By means of this advantageous development it is guaranteed that the respective engagement elements do not rotate together with the rotary movement of the respective adjusting element. By using guiding pins it is guaranteed that the chassis of the operating table base can move relative to the journal guide.

In a further advantageous development of the invention the first adjusting element and the first journal guide are arranged coaxially around the first journal and the second adjusting element and the second journal guide are arranged coaxially around the second journal. As a result, a very compact construction of the adjusting elements is possible.

Further, it is advantageous when the first adjusting unit has a first transport roller holder and a first bearing, the first bearing being arranged between the first journal guide and the first transport roller holder so that the first transport roller holder with the first transport roller is rotatably mounted about a vertical axis, and that the second adjusting unit has a second transport roller holder and a second bearing, the second bearing being arranged between the second journal guide and the second transport roller holder so that the second transport roller holder with the second transport roller is rotatably mounted about a vertical axis. The vertical axis is preferably the first or the second longitudinal axis of the journal. By means of this arrangement the transport rollers held by the respective transport roller holder can advantageously rotate and orientate about the vertical axis in a way as required by the desired direction of movement of the operating table base.

Further, it is advantageous when at least the first transport roller is individually held and guided by the first adjusting unit or when a first transport roller group composed of at least two transport rollers is held and guided by the first adjusting unit. Further, it is advantageous when at least the second transport roller is held and guided by the second adjusting unit or when a second transport roller group composed of at least two transport rollers is held and guided by the second adjusting unit. As a result, a simple connection between the transport rollers and the operating table is possible.

Further, it is advantageous when at least a drive roller drivable by means of a second drive unit is assigned to a lowering unit drivable by the first drive unit via the mechanical connecting means, via which lowering unit the drive roller is pivotable from a swiveled-on state into a swiveled-off state and/or from a swiveled-off state into a swiveled-on state. An advantage of this development is that no additional drive is necessary in order to swivel the drive roller on and off.

In a further advantageous development the drive unit changes in a first step the state of the transport rollers from the retracted state into the extracted state and in a second step the state of the drive roller from the retracted state into the extracted state. This happens by means of a continuous actuation of the first drive unit in one direction of movement, in particular direction of rotation. As a result, it is advantageously prevented that the drive roller is swiveled off by the user without the transport rollers being in the extracted state.

In addition, it is advantageous when the lowering unit has a stepped control profile with at least one step, the step connecting a first and a second step surface, wherein the control profile is mechanically firmly connected to the threaded rod, and wherein the control profile is movable together therewith. An actuating element is engaged with the control profile so that when the threaded rod is moved the control profile is guided past the actuating element and the actuating element slides over the first step. Here, by the actuating element, when moved over the at least one step of the control profile, an adjustment movement of the drive roller from the swiveled-off state into the swiveled-on state or from the swiveled-on state into the swiveled-off state takes place.

Alternatively, the actuating element can firmly be connected to the threaded rod and move past the control profile on the actuating element. Preferably, the actuating element is arranged such and the step surfaces of the control profile are designed such that a swiveling off of the drive roller only takes place when the transport rollers are in the extracted state and a further movement of the connecting means no longer causes any extraction of the transport rollers. The merely mechanical realization of this switching mechanism advantageously makes electronic switching and control elements redundant for this task.

Further, it is advantageous when the lowering unit has a spring which presses the drive roller with a pressing force against the floor. Thus, it is advantageously guaranteed that the drive roller also enables a uniform advance of the operating table base also in the case of an unevenness of the floor given a motor drive of the drive roller.

It is particularly advantageous when, in addition to the first and the second adjusting unit, the operating table base also comprises a third and a fourth adjusting unit with each time one assigned transport roller or an assigned transport roller group. Then, all four transport rollers can simultaneously be extracted and retracted by one drive via the mechanical connecting means by means of only one drive unit. As a result, the operating table is uniformly and simultaneously lifted and/or lowered independent of the load distribution of the operating table. As a result, a comfortable handling of the operating table for a patient lying on the patient support surface of the operating table is possible.

BRIEF DESCRIPTION OF THE DRAWINGS

Further features and advantages of the invention result from the following description which explains the invention in more detail on the basis of embodiments in connection with the enclosed Figures.

DETAILED DESCRIPTION

Figure 1:
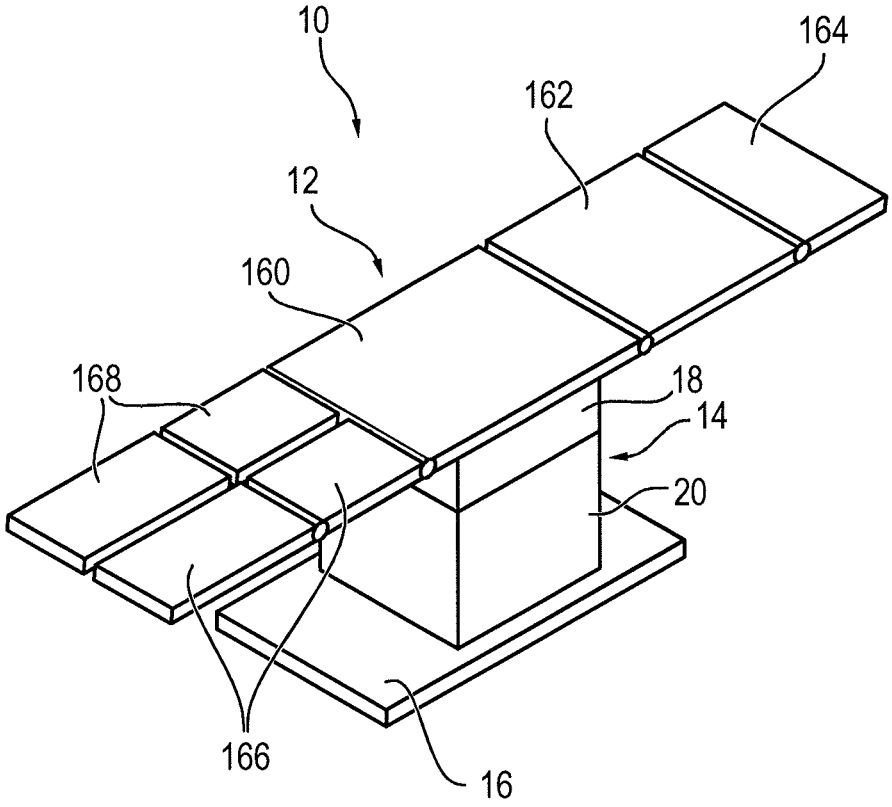
FIG. 1 shows a schematic illustration of an operating table with an operating table base according to a first embodiment of the invention.

FIG. 1 shows a schematic illustration of an operating table 10 according to a first embodiment of the invention with a patient support surface 12, an operating table column 14 and an operating table base 16. The operating table column 14 comprises a column head 18 and a base body 20.

The patient support surface 12 has several components adjustable relative to each other with respect to their position, which components enable a different positioning of a non-illustrated patient. In the present embodiment, the patient support surface 12 has a seat plate 160, a back plate 162, a head plate 164, a two-part left leg plate 166 and a two-part right leg plate 168.

Figure 2:
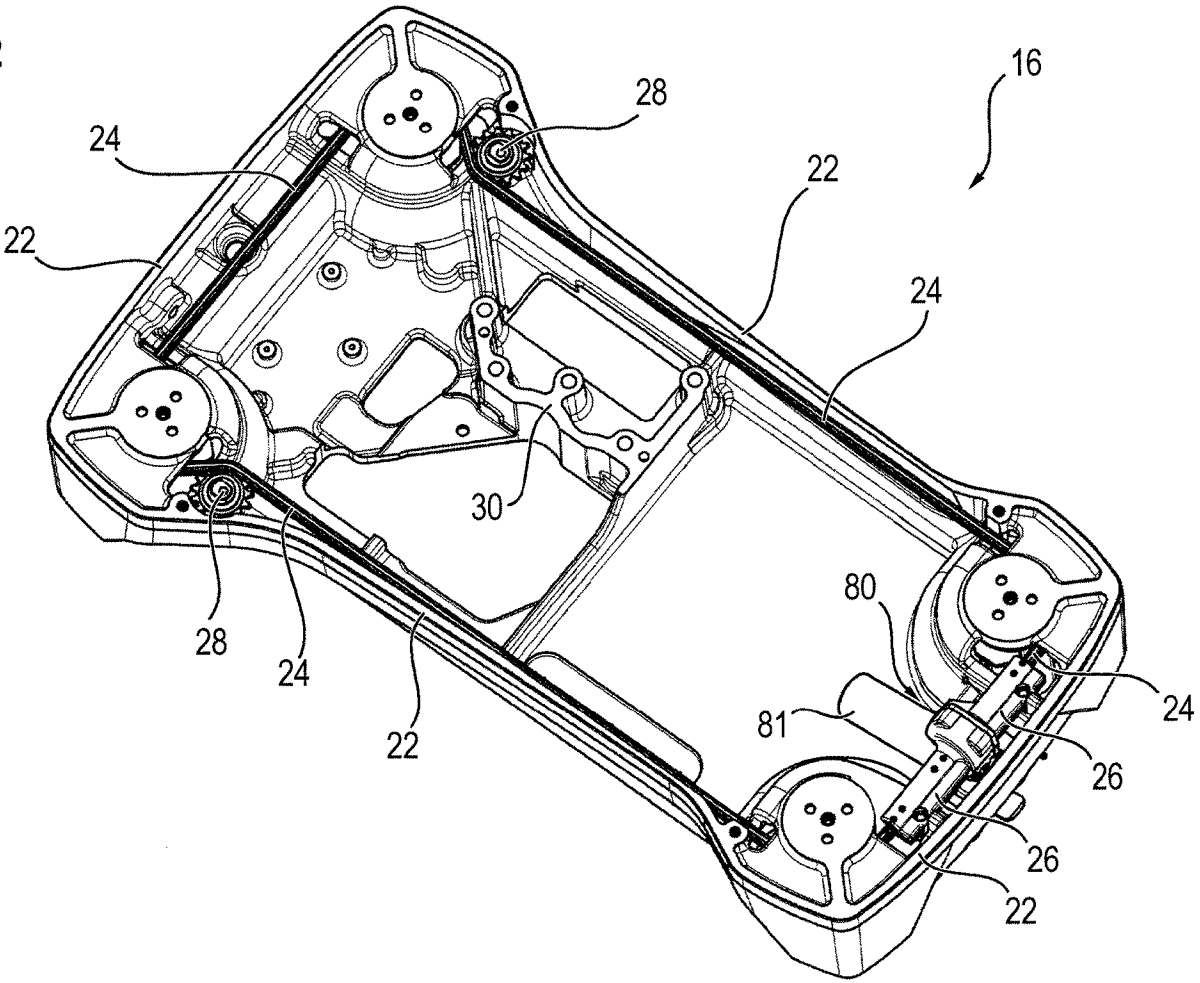
FIG. 2 shows a detailed perspective top view of the chassis of the operating table base with a first drive unit and a chain arranged in the chassis for driving four adjusting units.

In FIG. 2, a detailed perspective top view of the chassis 22 of the operating table base 16 with a drive unit 80 and a chain 24 arranged in the chassis 22 for driving four adjusting units is illustrated. Elements having the same structure or the same function are identified with the same reference signs. The cover plate of the operating table base 16 illustrated in FIG. 1 is not illustrated in FIG. 2 so that in FIG. 2 the chassis 22 and drive elements for retracting and extracting transport rollers from the operating table base 16 as well as a connecting flange 30 for connecting the operating table base 16 to the operating table column 14 are visible.

Figure 3:
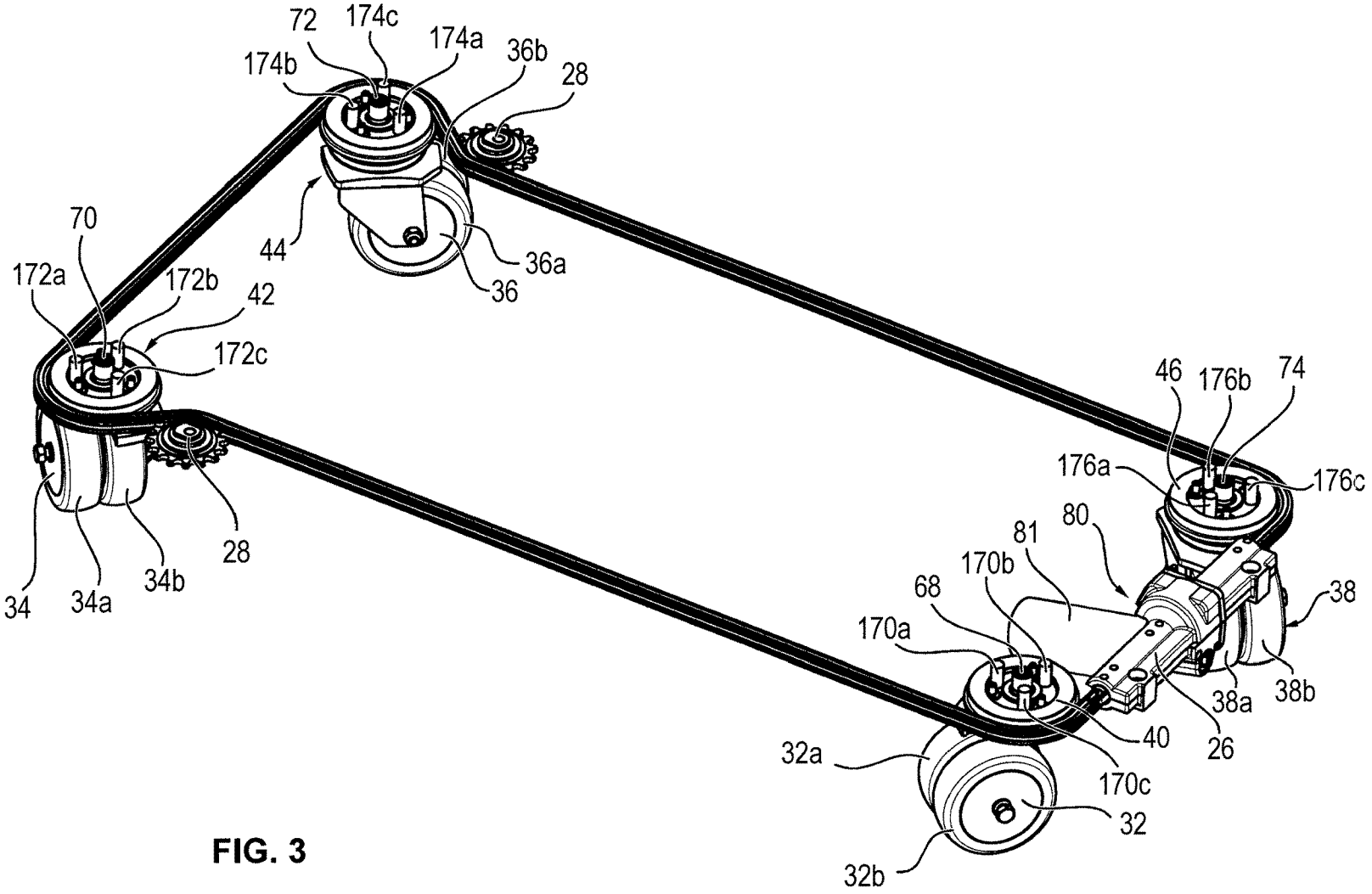
FIG. 3 shows the arrangement according to FIG. 2 without chassis, wherein the first drive unit and the four adjusting units, engaged with the chain, for adjusting one transport roller group each are each time illustrated with two transport rollers.

The drive unit 80 comprises an electric motor 81 and a transmission 26. The transmission 26 converts a rotary motion of the electric motor 81 into a translatory motion, a threaded rod not visible in FIG. 3 is moved along its longitudinal axis given a rotary motion of the electric motor 81. The two ends of the threaded rod are connected to the ends of a chain 24 serving as a mechanical connecting means, which chain together with the threaded rod forms a circulating drive train for driving four adjusting units, covered by the chassis 22 in FIG. 2, for extracting and retracting the transport rollers. The chain 24 is engaged with one engagement element each of the adjusting units. Further, two tensioning gearwheels 28 for guiding and tensioning the chain 24 are provided. The drive of the chain 24 is still explained in more detail in the following in connection with FIG. 4.

In FIG. 3, the arrangement according to FIG. 2 is shown without chassis 22, wherein the drive unit 80 and the four adjusting units 40 to 46, engaged with the chain 24, for adjusting one transport roller group 32 to 38 each with two transport rollers 32*a*, 32*b* to 38*a*, 38*b* each are illustrated.

The chain 24 is engaged with one engagement element each of the first adjusting unit 40, the second adjusting unit 42, the third adjusting unit 44 and the fourth adjusting unit 46. Upon a translatory movement of the chain 24, the engagements elements of the four adjusting units 40 to 46 are rotated in the same sense of rotation.

Each adjusting unit 40 to 46 has three guiding pins each, which are identified with 170*a* to 170*c*, 172*a* to 172*c*, 174*a* to 174*c* and 176*a* to 176*c*, and which are each in part received in complementary openings of the chassis 22 of the operating table base 16. Further, each adjusting unit 40 to 46 is firmly connected via a threaded portion 68 to 74 of one journal each to the chassis 22 of the operating table base 16.

The structure and the function of the identically constructed adjusting units 40 to 46 are described in the following in detail in connection with the FIGS. 6 to 9 exemplarily for the adjusting unit 40.

Figure 4:
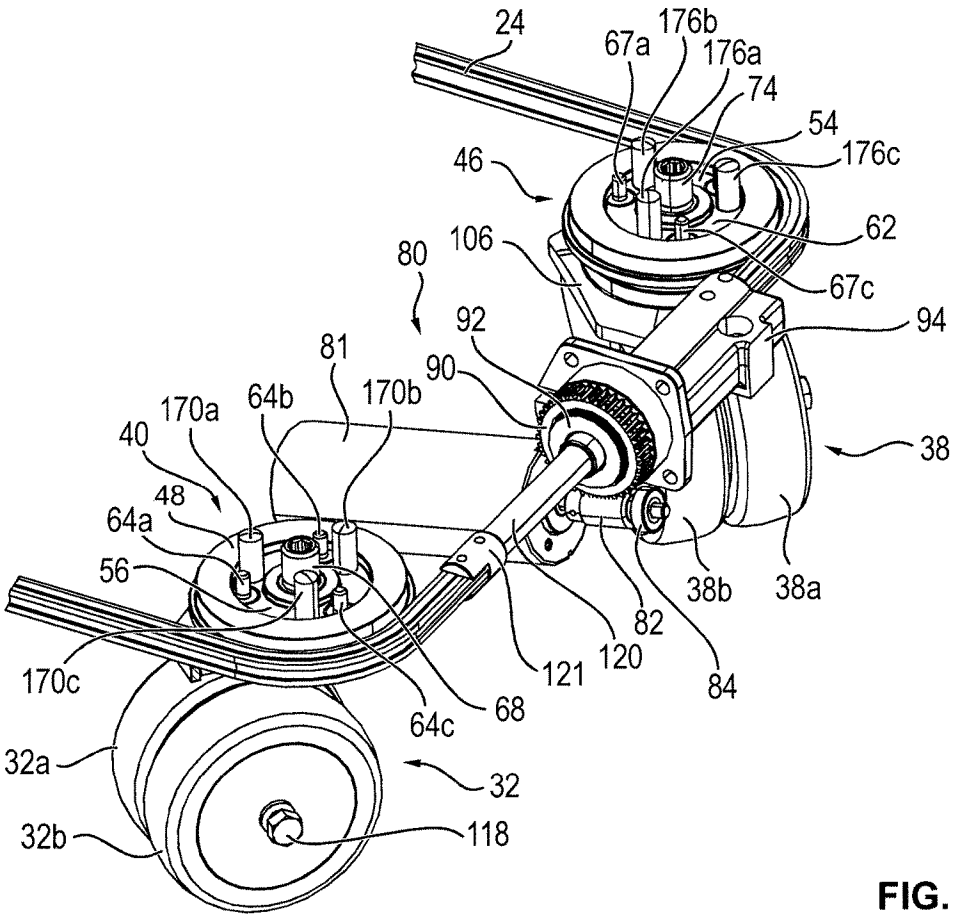
FIG. 4 shows a detail of the arrangement according to FIG. 3.

FIG. 4 shows a detail of the arrangement according to FIG. 3. It comprises the first adjusting unit 40, the fourth adjusting unit 46 and the transmission 26, as well as the drive unit 80. In contrast to FIG. 3, one housing half of the transmission 26, which inter alia serves to axially mount the transmission 26, has been omitted.

The first drive unit 80 comprises the first electric motor 81, a worm gear 82 arranged on the output shaft of the electric motor 81 and a bearing 84 received in the chassis 22. The worm gear 82 is engaged with a gearwheel 90 having an internal thread and serving as a threaded nut. The worm gear 82 and the gearwheel 90 form a worm gearing. The gearwheel 90 is laterally delimited by one axial thrust bearing each so that it is fixed or stationary in the direction of the longitudinal axis of the threaded rod 120. The first axial thrust bearing 92 is received in a first housing element 94 of the transmission 26 and the second axial thrust bearing is received in a second housing element 94 of the transmission 26 not shown in FIG. 4, the gearwheel 90 being rotatable about the longitudinal axis of the threaded rod 120.

The internal thread of the gearwheel 90 is engaged with an external thread of the threaded rod 120. At the visible end of the threaded rod 120, one end of the chain 24 is mounted via a connecting element 121. The chain 24 forms by means of a further non-illustrated connection of the second end of the chain 24 with the second end of the threaded rod 120 a closed drive train. The chain 24 is engaged with the first adjusting unit 40 via an engagement element at the outside of the first adjusting unit 40.

The first adjusting unit 40 has a first adjusting element 48, a first journal guide 56 and a first threaded portion 68 which is formed at the upper end of a non-illustrated first journal. The first threaded portion 68 serves to establish a screw connection with the chassis 22. At the outer circumference of the first adjusting element 48 an engagement element in the form of a gearwheel segment is formed which is engaged with the chain 24. The first journal guide 56 has three upward projecting guiding pins 170*a* to 170*c* and three screws 64*a* to 64*c*. The guiding pins 170*a* to 170*c* project both in the retracted state of the transport rollers and in the extracted state of the transport rollers into openings provided for this in the chassis 22, the guiding pins 170*a* to 170*c* being moved along their longitudinal axis relative to the chassis 22 when the transport rollers are retracted and extracted. In doing so, the movement of the guiding pins 170*a* to 170*c* in the openings is guided, as a result whereof a rotation of the first journal guide 56 is prevented. By means of the screws 64*a* to 64*c*, the first adjusting element 48 is rotatably held on the chassis 22.

At the bottom of the first adjusting unit 40, a first transport roller group 32 with a first transport roller 32*a* and a second transport roller 32*b* is arranged. The first transport roller group 32 has an axis 118 which enables a rolling movement of the first transport roller 32*a* and of the second transport roller 32*b* about this axis.

The fourth adjusting unit 46 has a fourth adjusting element 54, a fourth journal guide 62 and a fourth threaded portion 74 formed at the top of a fourth journal. The threaded portion 74 serves to establish a screw connection with the chassis 22. At the outer circumference of the fourth adjusting element 54 an engagement element in the form of a gearwheel segment is formed which is engaged with the chain 24. The fourth journal guide 62 has three upward projecting guiding pins 176*a* to 176*c* and three screws 67*a* to 67*c*. The guiding pins 176*a* to 176*c* project both in the retracted state of the transport rollers and in the extracted state of the transport rollers into openings provided for this in the chassis 22, the guiding pins 176*a* to 176*c* being moved along their longitudinal axis relative to the chassis 22 when the transport rollers are retracted and extracted. In doing so, the movement of the guiding pins 176*a* to 176*c* in the openings is guided, as a result whereof a rotation of the fourth journal guide 62 is prevented. By means of the screws 67*a* to 67*c* the fourth adjusting element 54 is rotatably held on the chassis 22.

At the bottom of the fourth adjusting unit 46 a fourth transport roller group 38 with a seventh transport roller 38*a* and an eighth transport roller 38*b* is arranged. The fourth transport roller group 38 has a fourth axis which enables a rolling movement of the seventh transport roller 38*a* and the eighth transport roller 38*b* about this axis.

Figure 5:
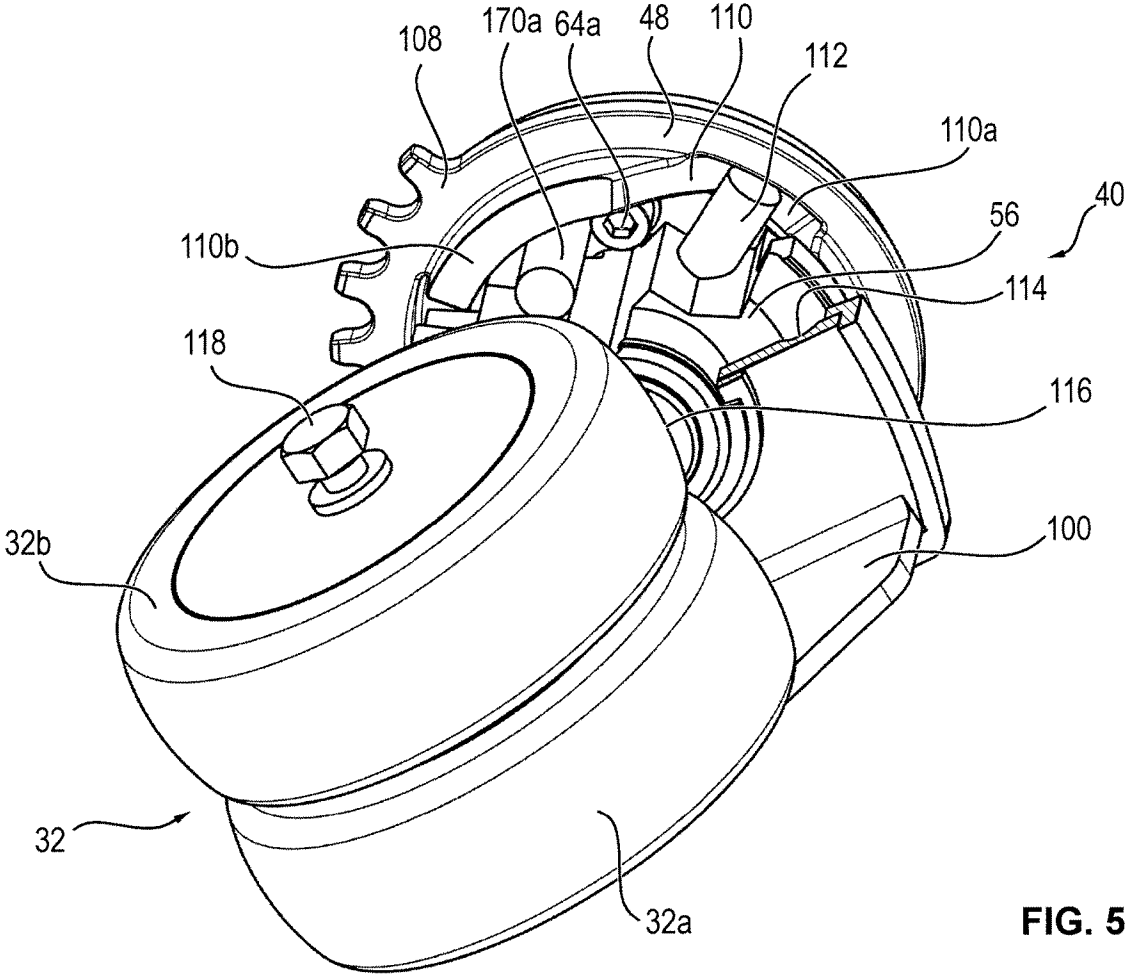
FIG. 5 shows a detailed perspective view of the first adjusting unit from below.

In FIG. 5, a detailed perspective view of the first adjusting unit 40 together with the first transport roller group 32 is illustrated from below. On the outer circumference, the first adjusting element 48 has a gearwheel segment 108, the center axis of which corresponds to the longitudinal axis of the first journal 116 so that it is rotatable about this longitudinal axis. Moreover, the first adjusting unit 48 has an inclined surface 110 which is followed by a first level surface 110*a* and a second level surface 110*b*. The first level surface 110*a* and the second level surface 110*b* are not inclined with respect to the horizontal.

In a horizontal plane, the first adjusting element 48 is arranged coaxially around the first journal guide. A first engagement element 112 of the first journal guide 56 designed as a cylindrical pin is horizontally oriented and contacts the first level surface 110*a* of the first adjusting element 48. In particular, the first level surface 110*a* rests on the first engagement element 112. When the first adjusting element 48 is rotated clockwise from this point of view, then, successively, at first the inclined surface 110 and then the second level surface 110*b* contact the first engagement element 112.

In this view shown in FIG. 5, also the lower side of the screw 64*a* is visible. The upper area of the guiding pin 170*a* is, as already mentioned, just as the further non-illustrated guiding pins 170*b*, 170*c* guided in the non-illustrated chassis 22. As a result, the first journal guide 56 cannot perform a rotary movement about its vertical longitudinal axis. The longitudinal axis referred to as first longitudinal axis is at the same time the longitudinal axis of the first journal guide 56 and of the first journal 116.

At the lower side of the first journal guide 56, a first transport roller holder 100 is rotatably mounted about an axis of rotation via a first pivot bearing 114. This axis of rotation coincides with the first longitudinal axis. On the transport roller holder 100, the first transport roller group 32 is mounted. Both transport rollers 32*a*, 32*b* of the transport roller group 32 have a common axis 118. The transport roller group 32 can freely rotate about the axis of rotation of the transport roller holder 100.

The first adjusting element 48 is rotatably mounted about the first longitudinal axis of the journal 116. When the first adjusting element 48 performs a rotary movement in clockwise direction from the view shown in FIG. 5, then the first level surface 110*a* and thereafter the first inclined surface 110 slide over the engagement element 112 until the second level surface 110*b* is arranged above the first engagement element 112. This corresponds to a change of the state of the first transport roller group 32 from the retracted state into the extracted state. The adjusting element 48 has been displaced upward, i.e. in a direction facing away from the first transport roller group 32. As a result, the chassis 22 of the operating table base 12 is lifted together with the further elements of the operating table 10 when the transport rollers 32*a*, 32*b* of the transport roller group 32 are extracted by the described operation and move out of the chassis at the bottom side.

Figure 6:
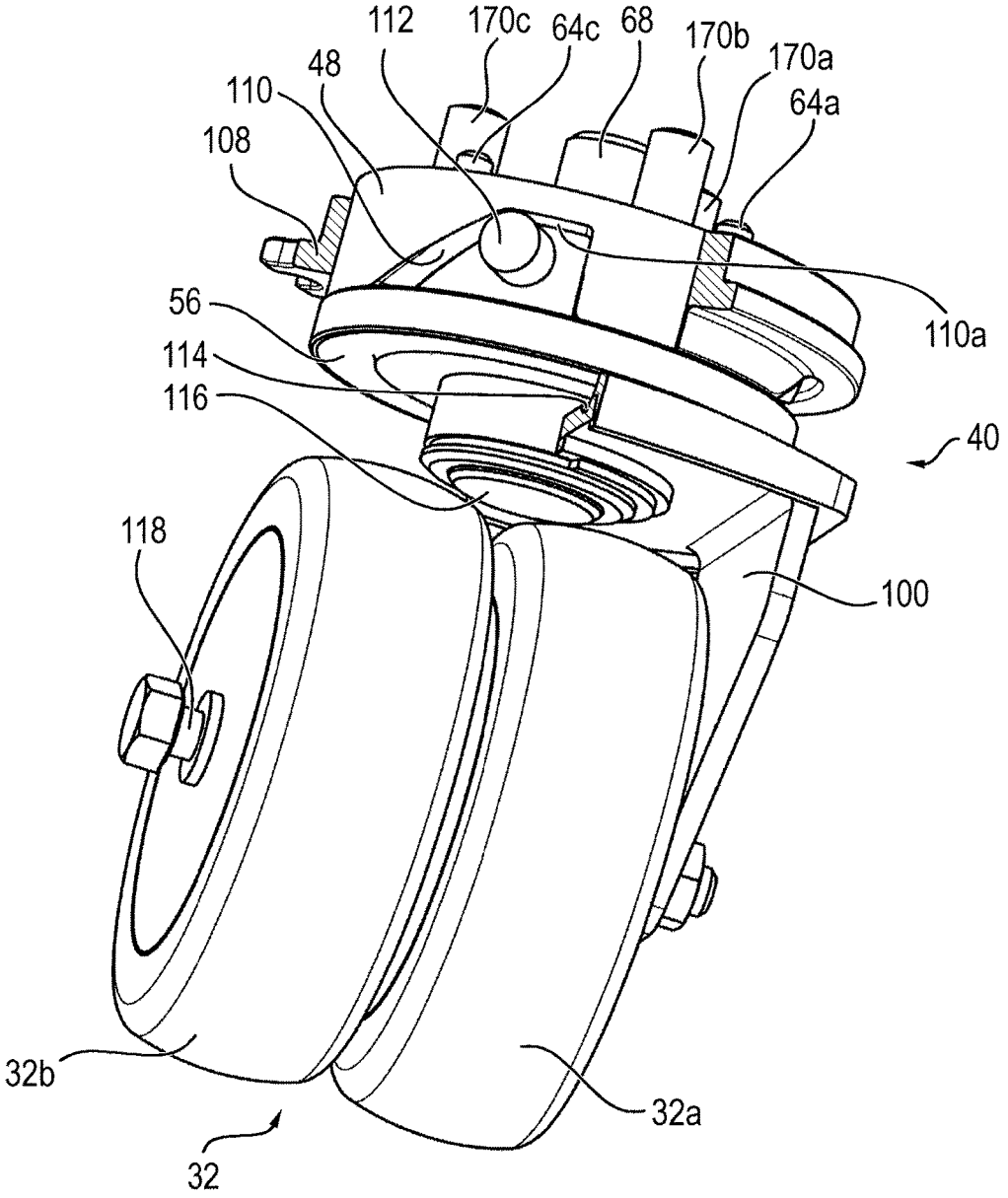
FIG. 6 shows a detailed perspective side view of the first adjusting unit in a retracted state of the first transport roller group.

FIG. 6 shows a detailed perspective side view of the first adjusting unit 40 in the retracted state of the first transport roller group 32. In addition to the elements shown in FIG. 5, the upper area of the guiding pins 170*a*, 170*b* and the upper area of the screws 64*a*, 64*b* can be seen.

Figure 7:
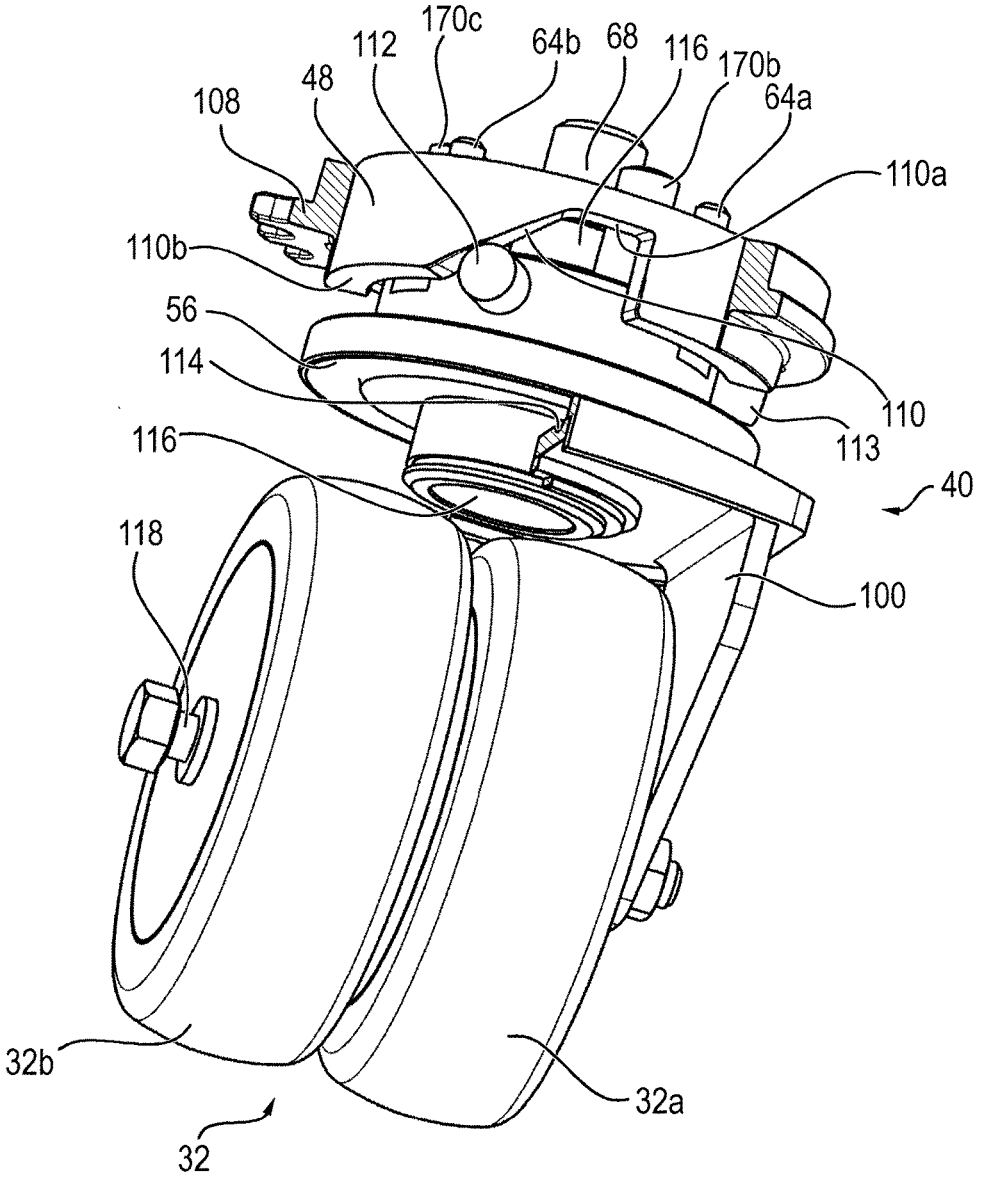
FIG. 7 shows the perspective side view according to FIG. 6 in which the first adjusting unit is illustrated in an intermediate state between the retracted state and the extracted state of the first transport roller group.

FIG. 7 shows the perspective side view according to FIG. 6, in which the first adjusting unit 40 is illustrated in an intermediate state between the retracted state and the extracted state of the first transport roller group 32. The first adjusting element 48 has been rotated clockwise so far and moved upward that the first inclined surface 110 rests on the first engagement element 112.

In addition to the first engagement element 112 of the first adjusting unit 40, a further engagement element 113 is visible in FIG. 7. This engagement element performs a parallel movement relative to the first engagement element 112 when the first adjusting element 48 is rotated. On the further engagement element 113, a second inclined surface of the first adjusting element 48, which is covered here, rests. The adjusting element 48 has altogether three inclined surfaces 110 arranged at an equal angular distance with respect to each other and the adjusting unit 40 has altogether three engagement elements 112, 113 arranged at equal angular distances.

Figure 8:
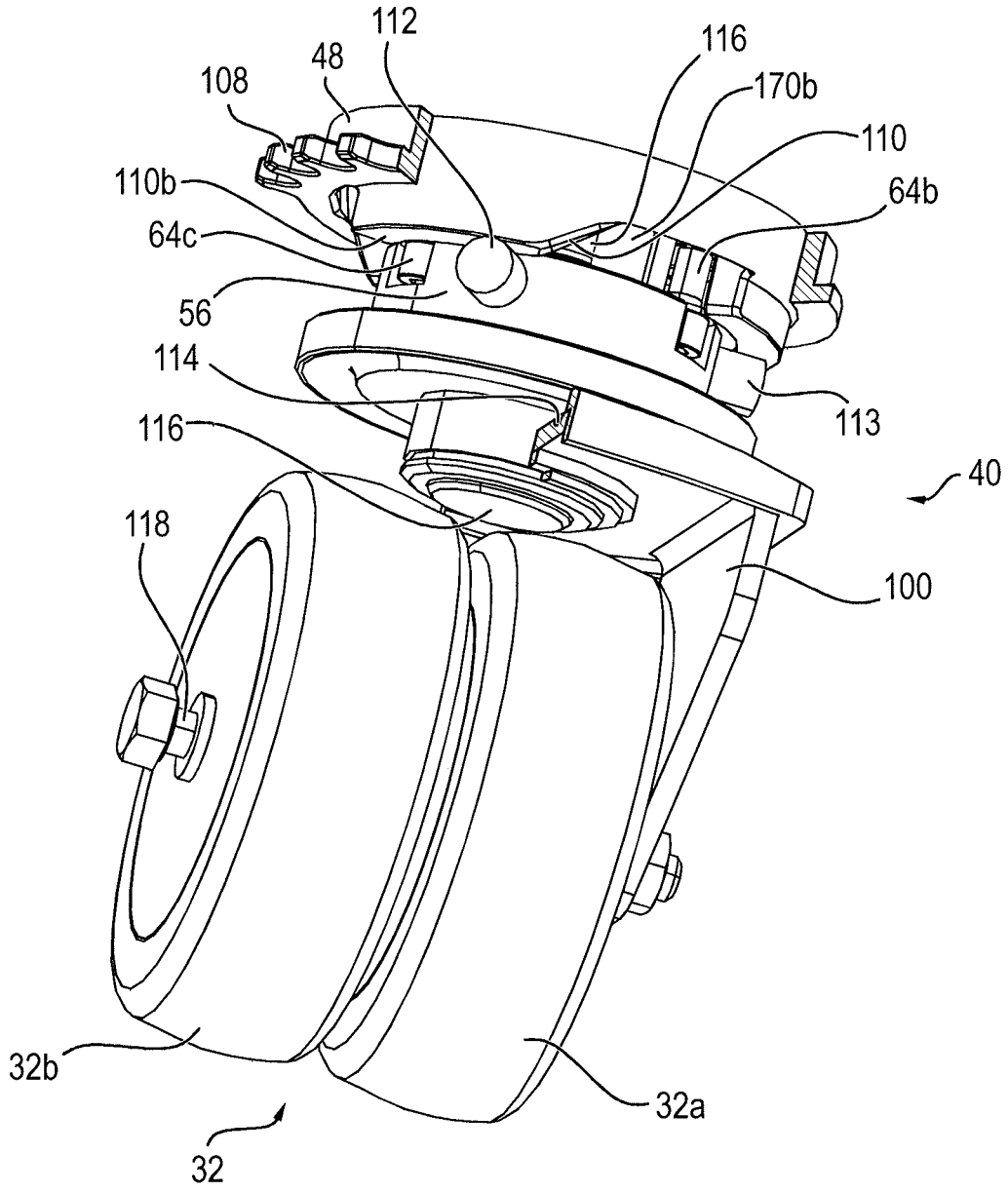
FIG. 8 shows the perspective side view according to FIGS. 6 and 7, in which the first adjusting unit is illustrated in the extracted state of the first transport roller group.

In FIG. 8, the perspective side view of the first adjusting unit 40 with the first transport roller group 32 according to FIGS. 6 and 7 is shown, in which the first adjusting unit 40 is illustrated in the extracted state of the first transport roller group 32. This state has been reached by a continued rotation of the first adjusting element 48 in clockwise direction from the position shown in FIG. 7. The first engagement element 112 and the further engagement element 113 have been rotated by the adjusting element 48 so far and lifted by sliding along the inclined surface 110 that the first engagement element 112 comes to rest underneath the second level surface 110*b*. This corresponds to the extracted state of the transport roller group 32. In particular, the first adjusting element 48 cannot be lowered again without a further opposite rotary movement. The operating table 10 lifted by the first adjusting element 48 is thus held in a stable position. Moreover, a further rotation of the adjusting element 48 in clockwise direction does not result in a further height adjustment of the adjusting element 48 and thus of the operating table 10 since the engagement element 112 slides along the level surface 110*b* and the further engagement elements slide along further non-illustrated level surfaces of the adjusting element 48.

Figure 9:
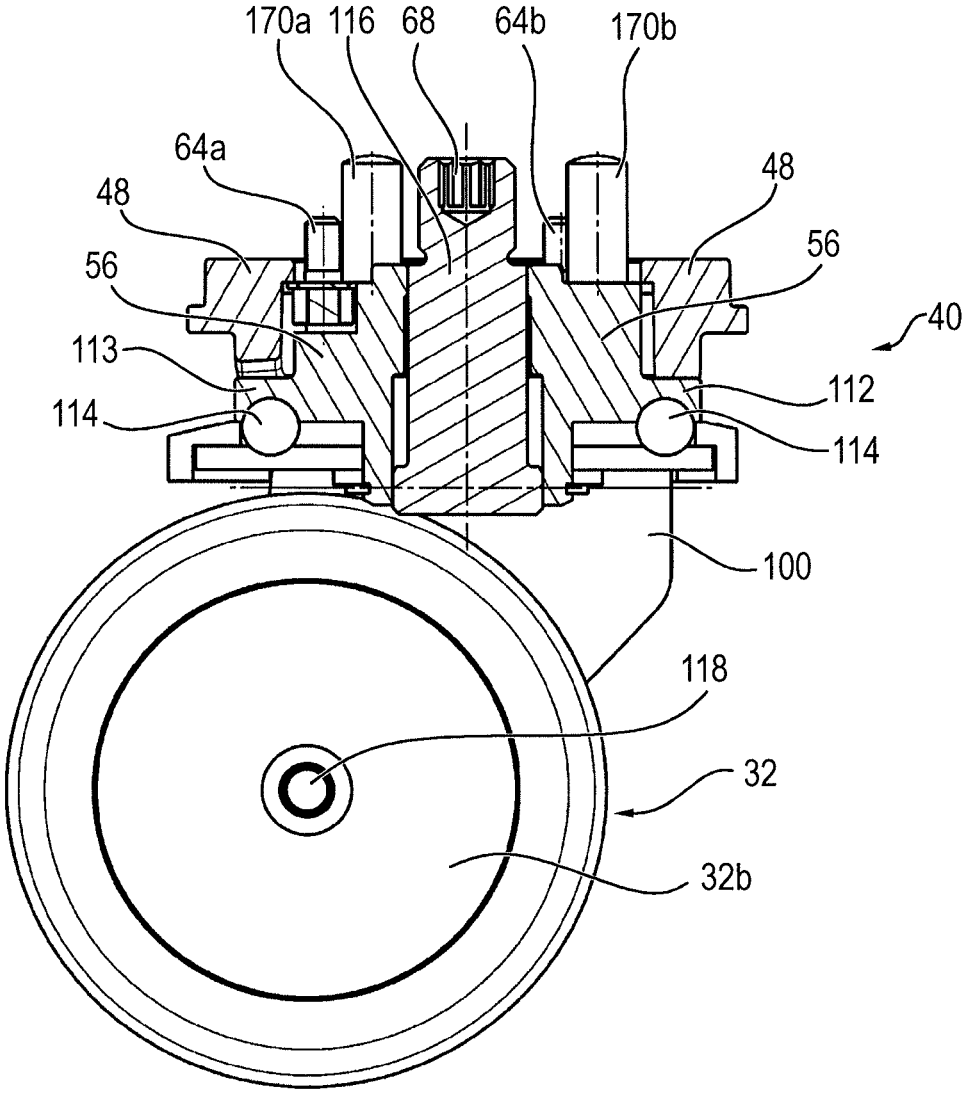
FIG. 9 shows a detailed sectional illustration of the first adjusting unit in a retracted state of the transport roller group.

FIG. 9 shows a detailed sectional view of the first adjusting unit 40 in the retracted state of the transport roller group 32. The first journal 116 is connectable to the chassis 22 of the operating table base 16 via the first threaded portion 68. The first journal guide 56 rests on the first pivot bearing 114 of the first transport roller holder 100. In particular, it can be seen how the first journal 116 is arranged vertically movably relative to the first journal guide 56.

The first adjusting element 48 is rotatably mounted about the first longitudinal axis of the first journal 116 and rests on the first engagement element 112 and the further engagement element 113 and the non-illustrated third engagement element.

Figure 10:
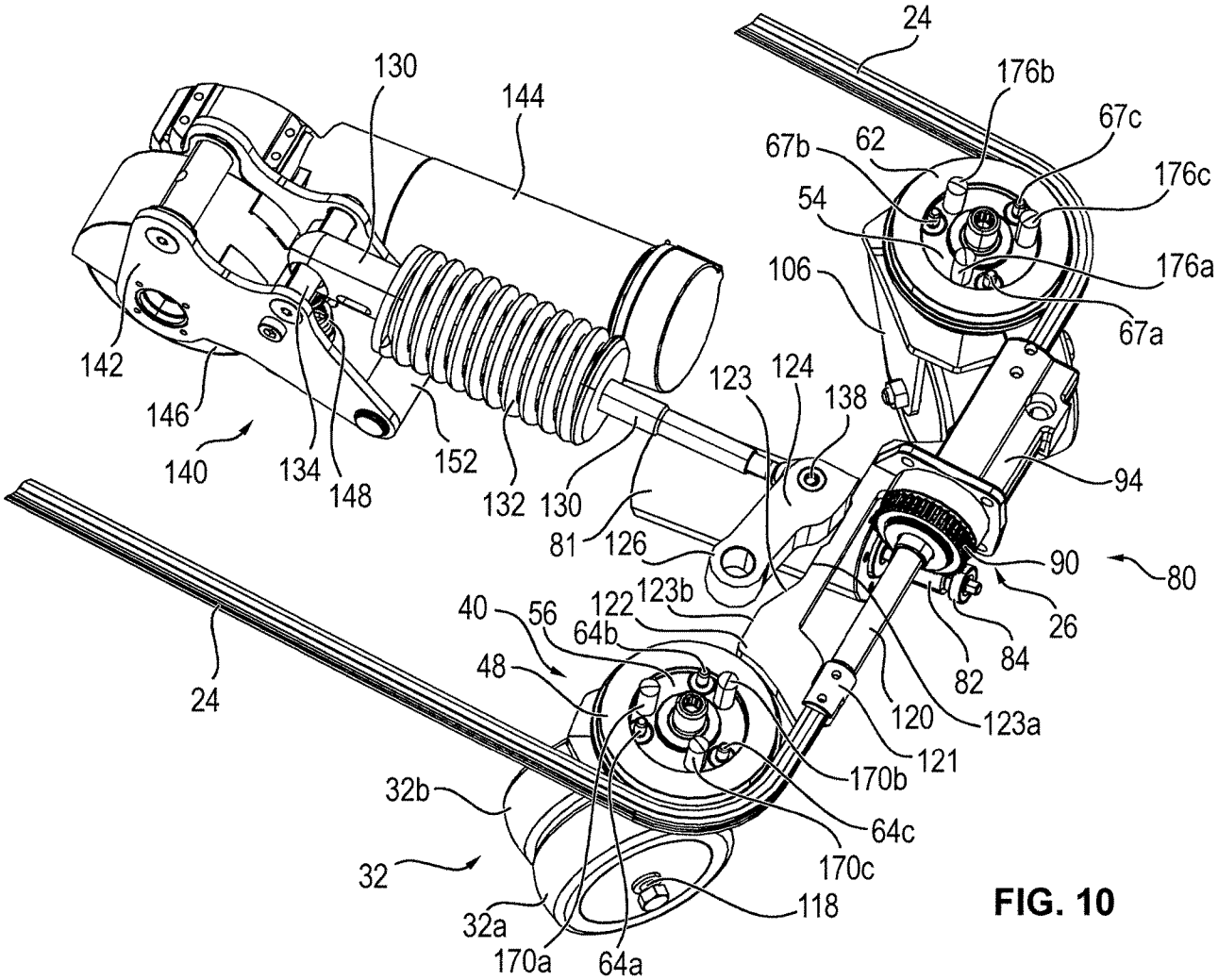
FIG. 10 shows a detailed illustration of a detail of an arrangement of drive elements which is contained in an operating table base according to a second embodiment.

In FIG. 10, a detailed illustration of a detail of an arrangement of drive elements contained in an operating table base according to a second embodiment is shown, similar to the first embodiment shown in FIG. 4. In contrast to FIG. 4, this second embodiment in addition contains a drive roller 146, a second drive unit 144 and a lowering unit 140. Further, a control profile 122 is firmly connected to the threaded rod 120. With this control profile 122 an actuating element 124 is engaged. With a first end, the actuating element 124 is rotatably mounted at a first pivot bearing 126 about a vertical axis of rotation. At a second end of the actuating element 124 opposite to the first end, this actuating element rests against the control profile 122. Here, the second end of the actuating element 124 is pressed against the control profile 122. A deflecting rod 130 is connected to the actuating element 124 such that given a rotation about the first pivot bearing 126 the deflecting rod 130 performs a translatory deflecting movement. On the deflecting rod 130, a biased compression spring 132 is mounted such that via a third pivot bearing 152 a drive roller holder 142 with a drive roller 146 mounted thereto is pressed onto a surface lying underneath, i.e. on the floor underneath the operating table base. A second drive unit 144 which drives the drive roller 146 by means of a motor is connected to the driver roller holder 142. In this embodiment, the second drive unit 144 is designed as an electric motor.

On the control profile, an inclined step 123 is formed between a first step surface 123*a* and a second step surface 123*b*. Upon a translatory movement of the control profile 122 in a first direction, the actuating element 124 slides from the first step surface 123*a* via the step 123 onto the second step surface 123*b*. In doing so, the deflecting rod 130 is displaced and thus the lowering unit 140 together with the drive roller 146 is swiveled off. In doing so, the drive roller 146 is pressed onto the floor underneath the operating table base.

When the control profile 122 is displaced in a second direction opposite to the first direction, then the deflecting rod 130 is displaced by means of a restoring spring 148 in the opposite direction so that the lowering unit 140 together with the drive roller 146 is no longer pressed against the floor. In doing so, the lowering unit 140 together with the drive roller 146 is swiveled away from the floor via the third pivot bearing 152. The force of the restoring spring 148 is less than the pressing force that can be exerted by the afore-mentioned pressure spring 132. The further function and the further structure of the operating table base according to the second embodiment correspond to the operating table base 16 of the first embodiment.

Figure 11:
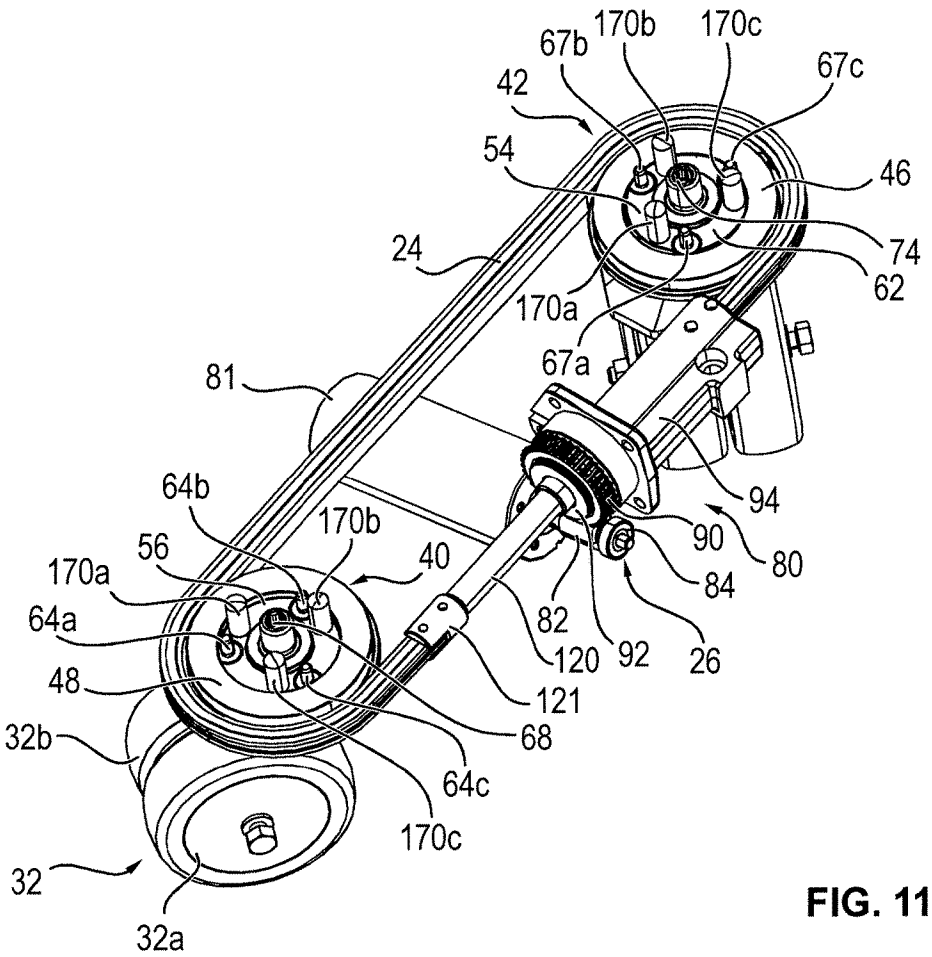
FIG. 11 shows a detailed illustration of a detail of an arrangement of drive elements of an operating table base according to a third embodiment.

In FIG. 11, a detailed illustration of a detail of an arrangement of drive elements of an operating table base according to a third embodiment is shown. In contrast to the arrangement of the first embodiment shown in FIG. 4, in the third embodiment only the first adjusting unit 40 and the second adjusting unit 42 are provided. Two further non-adjustable transport rollers of the operating table base of the third embodiment are not illustrated. These further transport rollers permanently project downward from the operating table base.

In this third embodiment, the chain 24 is directly guided around the first adjusting unit 40 and the second adjusting unit 42 without further adjusting units being engaged with the chain 24. The further function and the further structure of the operating table base according to the third embodiment correspond to the operating table base 16 of the first embodiment.

The embodiments of the invention described above are provided by way of example only. The skilled person will be aware of many modifications, changes and substitutions that could be made without departing from the scope of the present invention. The claims of the present invention are intended to cover all such modifications, changes and substitutions as fall within the spirit and scope of the invention.

What is claimed is:

1. An operating table base for an operating table, comprising:

a first transport roller and a second transport roller, each transport roller being moveable between a retracted position and an extracted position;

a first mechanical adjusting unit and a second mechanical adjusting unit configured to change a position of the first transport roller and of the second transport roller, respectively, from the retracted position to the extracted position; and a drive unit configured to drive a mechanical connecting element to actuate the first and second mechanical adjusting units to move the first and second transport rollers between the retracted position and the extracted position, respectively, wherein the operating table base rests in a fixed location when the transport rollers are in the retracted position, wherein the operating table base is movable on the transport rollers when the transport rollers are in the extracted position, wherein the mechanical connecting element engages a first gearwheel or gearwheel segment of the first mechanical adjusting unit and a second gearwheel or gearwheel segment of the second mechanical adjusting unit, wherein, in response to translation of the mechanical connecting element engaged with the gearwheels or gearwheel segments, the gearwheels or gearwheel segments rotate, and wherein in response to rotation of the gearwheels or gearwheel segments, the transport rollers move between the retracted position and the extracted position.

2. The operating table base according to claim 1, wherein the mechanical connection element is positioned to prevent exertion of force on the mechanical connecting element due to weight of the operating table when the transport rollers are in the extracted position.

3. The operating table base according to claim 1, wherein the mechanical connecting element is a chain or a belt, wherein the first and the second mechanical adjusting units are connected via the chain or the belt to the drive unit.

4. The operating table base according to claim 3, wherein the chain or the belt, together with the drive unit, forms a closed drive train.

5. The operating table base according to claim 4, wherein the drive unit comprises an electric motor configured to drive a threaded nut of a screw-type or worm gearing, wherein an internal thread of the threaded nut engages an external thread of a threaded rod of the screw-type or worm gearing, wherein the threaded nut is mounted to be stationary in a direction of a longitudinal axis of the threaded rod and rotatably about the longitudinal axis of the threaded rod, wherein a first end of the threaded rod is connected to first end of the chain or the belt, and wherein a second end of the threaded rod is connected to a second end of the chain or the belt.

6. The operating table base according to claim 4, wherein the drive unit comprises a synchronizing cylinder with a first piston rod and a second piston rod, wherein a free end of the first piston rod is connected to a first end of the chain or the belt, and wherein a free end of the second piston rod is connected to a second end of the chain or the belt.

7. The operating table base according to claim 1, wherein a first transport roller group is held and guided by the first mechanical adjusting unit, the first transport roller group comprising the first transport roller and a third transport roller, and a second transport roller group is held and guided by the second mechanical adjusting unit, the second transport roller group comprising the second transport roller and a fourth transport roller.

8. The operating table base according to claim 1, further comprising a drive roller configured to be driven by a second drive unit, wherein a lowering unit is configured to pivot the drive roller from a swiveled-on state to a swiveled-off state and/or from a swiveled-off state to a swiveled-on state in response to translation of the mechanical connecting element.

9. The operating table base according to claim 8, wherein the first drive unit is configured to change a position of the transport rollers from the retracted position to the extracted position and change the state of the drive roller from the swiveled-on state to the swiveled-off state.

10. An operating table base for an operating table, comprising:

a first transport roller and a second transport roller, each transport roller being moveable between a retracted position and an extracted position;

a first mechanical adjusting unit and a second mechanical adjusting unit configured to change a position of the first transport roller and of the second transport roller, respectively, from the retracted position to the extracted position; and a drive unit configured to drive a mechanical connecting element to actuate the first and second mechanical adjusting units to move the first and second transport rollers between the retracted position and the extracted position, respectively, wherein the operating table base rests in a fixed location when the transport rollers are in the retracted position, wherein the operating table base is movable on the transport rollers when the transport rollers are in the extracted position, wherein the first mechanical adjusting unit comprises:

a vertically arranged first journal with a vertical first longitudinal axis, a first journal guide for guiding a relative movement between the first journal guide and the first journal in vertical direction, a first adjusting element with a first inclined surface configured to engage a first engagement element of the first journal guide such that relative movement between the first adjusting element and the first engagement element moves the first engagement element along the first inclined surface resulting in a translatory adjustment movement of the first adjusting element, and wherein the second mechanical adjusting unit comprises:

a vertically arranged second journal with a vertical second longitudinal axis, a second journal guide for guiding a relative movement between the second journal guide and the second journal in vertical direction, and a second adjusting element with a second inclined surface configured to engage a second engagement element of the second journal guide such that relative movement between the second adjusting element and the second engagement element moves the second engagement element along the second inclined surface resulting in a translatory adjustment movement of the second adjusting element.

11. The operating table base according to claim 10, wherein the inclined surfaces of the first adjusting element and of the second adjusting element each have an inclination of greater than 0°, and the inclined surfaces of the first adjusting element and of the second adjusting element are each followed by a level surface having an inclination of 0°.

12. The operating table base according to claim 10, wherein:

an upper end of the first journal includes a connecting area connecting the first journal to a chassis of the operating table base, an upper end of the second journal includes a connecting area connecting the second journal to the chassis of the operating table base, the first adjusting element of the first mechanical adjusting unit is rotatably mounted about the first longitudinal axis, the second adjusting element of the second mechanical adjusting unit is rotatably mounted about the second longitudinal axis, the first adjusting element and the second adjusting element are connected to the drive unit via the mechanical connecting element so as to be rotated about the longitudinal axis of the respective journal in response to the drive unit translating the mechanical connecting element, and the first inclined surface engages the first engagement element in response to a change of the position of the first transport roller, and the second inclined surface engages the second engagement element in response to a change of the state of the second transport roller.

13. The operating table base according claim 10, wherein the first journal guide comprises a first guiding pin received in an opening of the operating table base that is complementary to the first guiding pin, the first guiding pin configured to prevent rotation of the first journal guide about the first longitudinal axis, and the second journal guide comprises a second guiding pin received in a second opening of the operating table base that is complementary to the second guiding pin, the second guiding pin configured to prevent rotation of the second journal guide about the second longitudinal axis.

14. The operating table base according to claim 10, wherein the first adjusting element and the first journal guide are arranged coaxially around the first journal and the second adjusting element and the second journal guide are arranged coaxially around the second journal.

15. The operating table base according to claim 10, wherein the first mechanical adjusting unit has a first transport roller holder and a first bearing, wherein the first bearing is arranged between the first journal guide and the first transport roller holder so that the first transport roller holder with the first transport roller is rotatably mounted about a first vertical axis, and the second mechanical adjusting unit has a second transport roller holder and a second bearing, wherein the second bearing is arranged between the second journal guide and the second transport roller holder so that the second transport roller holder with the second transport roller is rotatably mounted about a second vertical axis.

16. A movable operating table comprising:

the operating table base of claim 10; and a patient support surface for supporting a patient thereon.

17. A movable operating table comprising:

the operating table base of claim 1; and a patient support surface for supporting a patient thereon.

18. An operating table base for an operating table, comprising:

a first transport roller and a second transport roller, each transport roller being moveable between a retracted position and an extracted position;

a first mechanical adjusting unit and a second mechanical adjusting unit configured to change a position of the first transport roller and of the second transport roller, respectively, from the retracted position to the extracted position; and a drive unit configured to drive a mechanical connecting element to actuate the first and second mechanical adjusting units to move the first and second transport rollers between the retracted position and the extracted position, respectively, wherein the operating table base is restable in a fixed location when the transport rollers are in the retracted position, wherein the operating table base is movable on the transport rollers when the transport rollers are in the extracted position, wherein the mechanical connecting element engages the first mechanical adjusting unit and the second mechanical adjusting unit, wherein, in response to translation of the mechanical connecting element engaged with the mechanical adjusting units, the mechanical adjusting units rotate, and wherein in response to rotation of the mechanical adjusting units, the transport rollers move between the retracted position and the extracted position.

19. The operating table base of claim 18:

wherein the mechanical connecting element comprises a chain or a belt for simultaneously rotating the first mechanical adjusting unit and the second mechanical adjusting unit.

20. An operating table base for an operating table, comprising:

a first transport roller and a second transport roller, each transport roller being moveable between a retracted position and an extracted position;

a first mechanical adjusting unit and a second mechanical adjusting unit configured to change a position of the first transport roller and of the second transport roller, respectively, from the retracted position to the extracted position; and a drive unit configured to drive a mechanical connecting element to actuate the first and second mechanical adjusting units to move the first and second transport rollers between the retracted position and the extracted position, respectively, wherein the operating table base is restable in a fixed location when the transport rollers are in the retracted position, wherein the operating table base is movable on the transport rollers when the transport rollers are in the extracted position, wherein the first mechanical adjusting unit comprises:

a first adjusting element with a first inclined surface configured to engage a first engagement element such that relative movement between the first adjusting element and the first engagement element moves the first engagement element along the first inclined surface resulting in a translatory adjustment movement of the first adjusting element, and wherein the second mechanical adjusting unit comprises:

a second adjusting element with a second inclined surface configured to engage a second engagement element such that relative movement between the second adjusting element and the second engagement element moves the second engagement element along the second inclined surface resulting in a translatory adjustment movement of the second adjusting element.

21. The operating table base of claim 20:

wherein the first adjusting element further comprises a first level surface and and a second level surface, both configured to engage the first engagement element, and located at opposite ends of the first inclined surface;

wherein the first engagement element contacts the first level surface when the first transport roller is in the retracted position; and wherein the first engagement element contacts the second level surface when the first transport roller is in the extracted state.

* * * * *